US009702604B2

(12) United States Patent
Kaneko

(10) Patent No.: US 9,702,604 B2
(45) Date of Patent: Jul. 11, 2017

(54) EXPANSION VALVE

(71) Applicant: Takeshi Kaneko, Tokyo (JP)

(72) Inventor: Takeshi Kaneko, Tokyo (JP)

(73) Assignee: TGK CO., LTD., Tokyo (JP)

( * ) Notice: Subject to any disclaimer, the term of this patent is extended or adjusted under 35 U.S.C. 154(b) by 382 days.

(21) Appl. No.: 13/843,593

(22) Filed: Mar. 15, 2013

(65) Prior Publication Data

US 2013/0247609 A1 Sep. 26, 2013

(30) Foreign Application Priority Data

Mar. 22, 2012 (JP) ..... 2012-065936

(51) Int. Cl.
*F25B 49/02* (2006.01)
*F25B 41/06* (2006.01)

(52) U.S. Cl.
CPC ..... *F25B 49/02* (2013.01); *F25B 41/062* (2013.01); *F25B 2341/0683* (2013.01); *F25B 2500/13* (2013.01)

(58) Field of Classification Search
CPC .... F25B 49/00; F25B 2500/13; F25B 41/062; F25B 2341/0683
See application file for complete search history.

(56) References Cited

U.S. PATENT DOCUMENTS 5,146,766 A * 9/1992 Martins ..... F16L 39/00 62/298
5,467,611 A * 11/1995 Cummings et al. ..... 62/299
6,241,157 B1 * 6/2001 Yano et al. ..... 236/92 B
2005/0016208 A1 * 1/2005 Hirota ..... F25B 41/062 62/527
2006/0196201 A1 * 9/2006 Sendo et al. ..... 62/222
2010/0237270 A1 * 9/2010 Kobayashi et al. ..... 251/331
(Continued)

FOREIGN PATENT DOCUMENTS

DE 299 09 494 U1 9/1999 ..... B60H 1/00
DE 102006017420 A1 10/2007 ..... F16K 51/00
EP 1 500 885 A1 1/2005 ..... F25B 41/06
(Continued)

OTHER PUBLICATIONS

JP2012-065936, Notice of Reason(s) for Refusal, Japanese Language, Feb. 24, 2016, Dispatch No. 083602, TGK12-106.
(Continued)

*Primary Examiner* — Elizabeth Martin
*Assistant Examiner* — Zachary R Anderegg
(74) *Attorney, Agent, or Firm* — Martine Penilla Group, LLP

(57) ABSTRACT

An expansion valve according to an embodiment includes a mounting hole: that has its central axis at a height position between a first refrigerant passage and a second refrigerant passage in the body thereof; that is provided so as to penetrate a first side surface and a second side surface; and that is used for inserting, from the side of the second side surface, a bolt for fastening a mounting member on an evaporator side and the body. The mounting hole has, in an inside thereof, a stopper surface for stopping the head of the bolt in an insertion direction, and the stopper surface is formed so as to be located near to the first side surface relative to a central axis of a shaft.

5 Claims, 10 Drawing Sheets

(56) References Cited

U.S. PATENT DOCUMENTS

2012/0192970 A1* 8/2012 Kobayashi et al. ..... 137/468

FOREIGN PATENT DOCUMENTS

| | | | | |
|---|---|---|---|---|
| EP | 1 598 581 A | 11/2005 | ..... | F16K 31/00 |
| JP | 09-026235 | 1/1997 | ..... | F25B 41/06 |
| JP | 11-325660 | 11/1999 | ..... | F25B 41/06 |
| JP | 2005-008091 | 1/2005 | ..... | B60H 1/32 |
| JP | 2006-003056 | 1/2006 | ..... | F25B 41/06 |
| JP | 2006-078140 | 3/2006 | ..... | F25B 41/06 |
| JP | 2007002902 A | 1/2007 | ..... | F16K 27/00 |
| WO | WO2005/095833 A1 | 10/2005 | ..... | F16K 31/122 |

OTHER PUBLICATIONS

JP2012-065936, Notice of Reason(s) for Refusal, Dispatch Date: Feb. 24, 2016, English Translation, Dispatch No. 083602, Ref. No. TGK12-106.

JP2012-065936, Notice of Reason(s) for Refusal, Dispatch Date: Aug. 18, 2015, Dispatch No. 374069, Ref. No. TGK12-106.

* cited by examiner

EXPANSION VALVE

CLAIM OF PRIORITY TO RELATED APPLICATION

The present application is claiming priority of Japanese Patent Application No. 2012-065936, filed on Mar. 22, 2012, the content of which is incorporated herein by reference.

BACKGROUND OF THE INVENTION

1. Field of the Invention

The present invention relates to an expansion valve, and in particular, to an expansion valve that is provided in a refrigeration cycle to control the flow rate of a refrigerant to be delivered to an evaporator.

2. Description of the Related Art

The refrigeration cycle of an automotive air-conditioner generally comprises: a compressor for compressing a circulating refrigerant; a condenser for condensing the compressed refrigerant; a receiver for separating the condensed refrigerant into vapor and liquid; an expansion valve for throttling and expanding the separated liquid refrigerant to change it in a mist state and for delivering the misty refrigerant; and an evaporator for evaporating the misty refrigerant to cool the air in a vehicle interior by the latent heat of vaporization.

As the expansion valve, a thermostatic expansion valve is used, which opens and closes, by sensing a temperature and a pressure of the refrigerant on the outlet side of the evaporator, a valve portion such that the refrigerant delivered from the evaporator has a predetermined degree of superheat in order to control the flow rate of the refrigerant to be delivered to the evaporator. In the body of the expansion valve, a first passage for making the refrigerant moving from the receiver to the evaporator pass through and a second passage for making the refrigerant, which has returned from the evaporator, pass through to deliver it to the compressor are formed. A valve hole is formed in the intermediate portion of the first passage, and a valve element for adjusting, by attaching and detaching the valve hole, the flow rate of the refrigerant moving to the evaporator is arranged. A power element for controlling, by sensing the temperature and pressure of the refrigerant flowing through the second passage, an opening degree of the valve portion is provided at the end portion of the body. The drive force of the power element is transmitted to the valve element via a lengthy shaft. The shaft extends so as to cross the second passage and reach the first passage, and is slidably supported by an insertion hole provided in a partition wall by which the first passage and the second passage are partitioned from each other in the body.

Such an expansion valve is installed in an engine room of a vehicle, a vehicle interior, or a partition wall by which the former two are partitioned from each other, and a plurality of pipes are connected thereto via plate-shaped joints (see, e.g., Patent Document 1). That is, the pipe extending from the receiver is connected to the inlet port of the first passage in the body of the expansion valve, and the pipe extending toward the evaporator is connected to the outlet port. Further, the pipe extending from the evaporator is connected to the inlet port of the second passage, and the pipe extending toward the compressor is connected to the outlet port. Each of the pipes is fixed to the expansion valve by, for example, inserting a lengthy bolt through a mounting hole that is formed to penetrate the body of the expansion valve and by tightening the aforementioned joint to the body.

Because an aluminum material, etc., which is excellent in weight saving or processability, is often used in the bodies of such expansion valves, the coefficient of thermal conductivity of the body is relatively high. Accordingly, it is concerned that the temperature of the high-temperature refrigerant on the upstream side from the valve hole in the first passage, or the temperature of the low-temperature refrigerant on the downstream side from the valve hole therein, may be transmitted to the power element via the body, thereby causing a bad influence on the operation of the expansion valve. That is, there is the possibility that a temperature sensing error may be caused in the power element due to the transmission of the temperature on the first passage side. Thus, a technique is proposed, in which the heat transfer from a first passage to a power element is suppressed by, for example, separately forming, with machining, a space between the first passage side and a second passage (see, e.g., Patent Document 2).

PATENT DOCUMENTS

[Patent Document 1] Japanese Patent Application Publication No. 1999-325660

[Patent Document 2] Japanese Patent Application Publication No. 2006-78140

However, production cost may be increased by performing such separate machining only for suppressing heat transfer. Also, it is needed to provide holes for inserting bolts in the body in addition to the aforementioned plurality of passages, and hence there is the problem that it is not easy to effectively form a space in a limited space.

SUMMARY OF THE INVENTION

The present invention has been made in view of such a problem, and a purpose of the invention is to achieve, easily and at low cost, a structure for preventing a temperature sensing error in an expansion valve.

In order to solve the aforementioned problem, an expansion valve according to an embodiment of the present invention is one: that is provided in a refrigeration cycle; that throttles and expands a refrigerant flown in via an external heat exchanger by making the refrigerant pass through a valve portion in an inside thereof to supply to an evaporator; and that controls an opening degree of the valve portion by sensing a pressure and a temperature of the refrigerant that has returned from the evaporator and delivers the refrigerant toward a compressor. The expansion valve comprises: a first refrigerant passage that is formed so as to penetrate a body thereof, and at one end side of which a first inlet port for introducing the refrigerant from the external heat exchanger is provided, while at the other end side of which a first outlet port for delivering the refrigerant to the evaporator is provided; a valve hole provided in an intermediate portion of the first refrigerant passage; a valve chamber provided between the valve hole and the first inlet port in the first refrigerant passage; a valve element that is arranged in the valve chamber for opening and closing the valve portion by touching and leaving the valve hole; a second refrigerant passage that is formed separately from the first refrigerant passage so as to penetrate the body thereof, and at one end side of which a second inlet port for introducing the refrigerant that has returned from the evaporator is provided, while at the other end side of which a second outlet port for delivering the refrigerant to the compressor is provided; a power element that is provided on a side opposite to the first refrigerant passage with respect to the second refrigerant passage in the body, and that works by sensing the temperature and pressure of the refrigerant flowing through the second refrigerant passage; an actuating rod whose one end side crosses the second refrigerant passage to be connected to the power element and whose other end side penetrates both a partition wall between the first refrigerant passage and the second refrigerant passage and the valve hole to be connected to the valve element, and that transmits the drive force of the power element to the valve element; and a mounting hole that has its central axis at a height position between the first refrigerant passage and the second refrigerant passage in the body, and that is provided so as to penetrate both a first side surface, on which the first outlet port and the second inlet port are opened, and a second side surface located on the back surface side of the first side surface, and that is used for inserting, from the side of the second side surface, a screw for tightening a mounting member on the evaporator side and the body together. The mounting hole has, in an inside thereof, a stopper surface for stopping the head of the screw in an insertion direction, and the stopper surface is formed so as to be located near to the first side surface relative to a central axis of the actuating rod.

According to this embodiment, most of the mounting hole for inserting a screw by which the mounting member on the evaporator side and the body are tightened together can be made to function as a space for stopping the heat transfer from the first refrigerant passage to the second refrigerant passage in the body. That is, because a stopper surface for stopping the head of the screw is provided in the inside of the mounting hole and the stopper surface is located near to the first side surface relative to the central axis of the actuating rod, a large space can be formed near to the second side surface relative to the head of the screw when the screw has been tightened. Because the space is formed simultaneously when a mounting hole for a bolt, which is essential in an expansion valve, is formed, processing steps are not particularly increased, and a problem regarding space is hardly caused. That is, according to this embodiment, it becomes possible to achieve, easily and at low cost, a structure for preventing a temperature sensing error in an expansion valve.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE INVENTION

Figure 1:
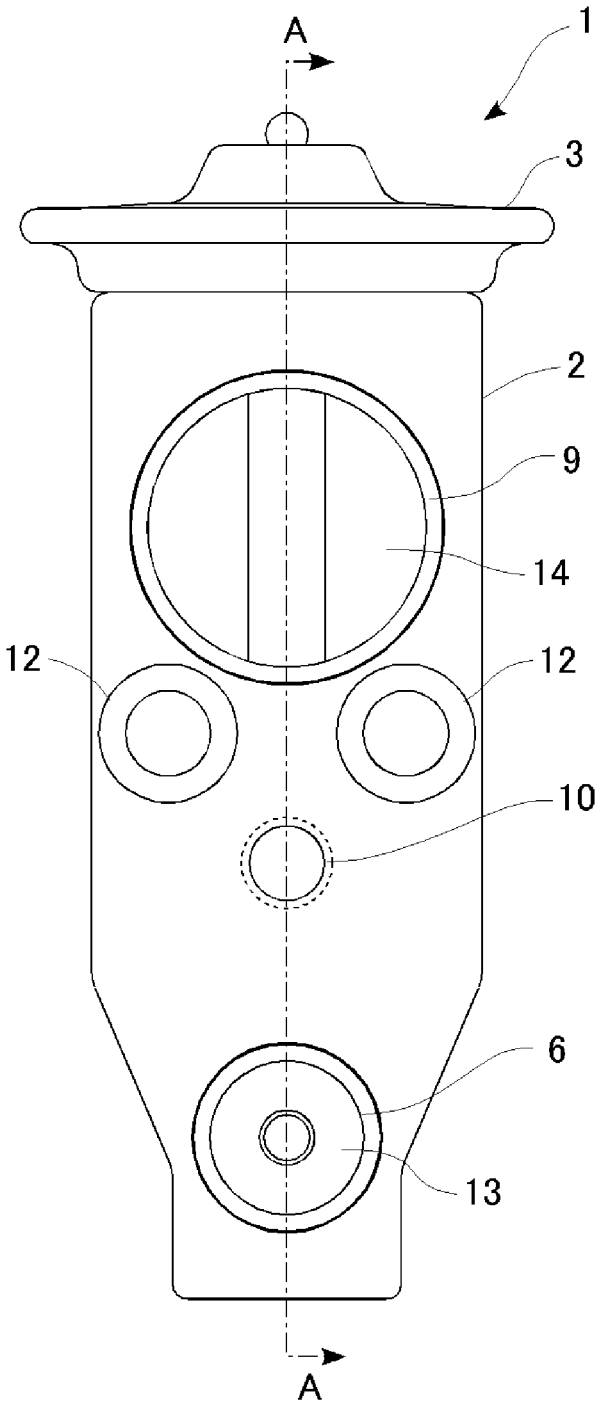
FIG. 1 is a front view of an expansion valve according to First embodiment.

The invention will now be described based on preferred embodiments which do not intend to limit the scope of the present invention but exemplify the invention. All of the features and the combinations thereof described in the embodiment are not necessarily essential to the invention.

Hereinafter, embodiments of the present invention will be described in detail with reference to the accompanying drawings. In the following description, for convenience, positional relationships among respective structures may be expressed on the basis of the illustrated conditions. Also, in the following embodiments and variations, like components are denoted with like reference numerals and description thereof may be appropriately omitted.

First Embodiment

In the present embodiment, an expansion valve according to the present invention is embodied as a thermostatic expansion valve to be applied to a refrigeration cycle of an automotive air-conditioner. The refrigeration cycle comprises: a compressor for compressing a circulating refrigerant; a condenser for condensing the compressed refrigerant (functions as an "exterior heat exchanger"); a receiver for separating the condensed refrigerant into vapor and liquid; an expansion valve for throttling and expanding the separated liquid refrigerant to change it in a mist state and for delivering the misty refrigerant; and an evaporator for evaporating the misty refrigerant to cool the air in a vehicle interior by the latent heat of vaporization. Detailed description of the aforementioned components other than the expansion valve will be omitted.

Figure 2:
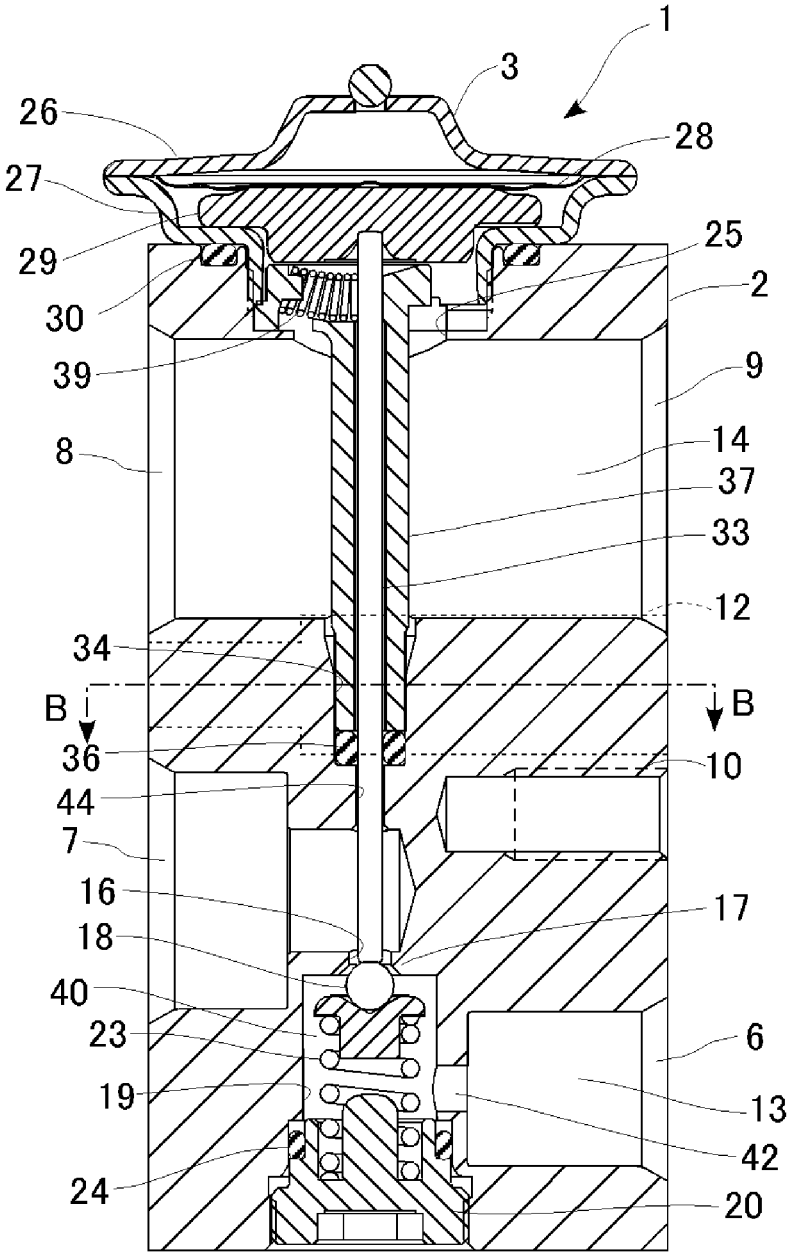
FIG. 2 is a sectional view of the expansion valve, taken along A-A Line in FIG. 1.
Figure 3A:
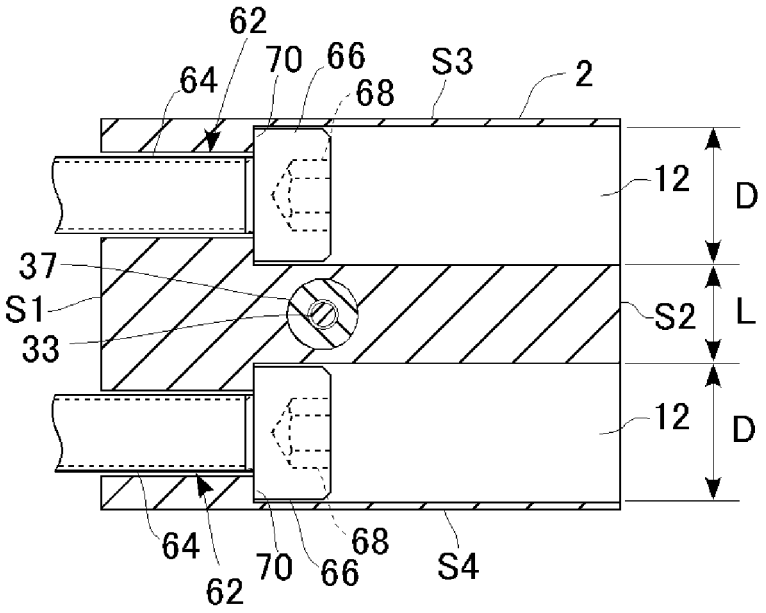
FIGS. 3A and 3B are sectional views of the expansion valve, taken along B-B Line in FIG. 2.
Figure 3B:
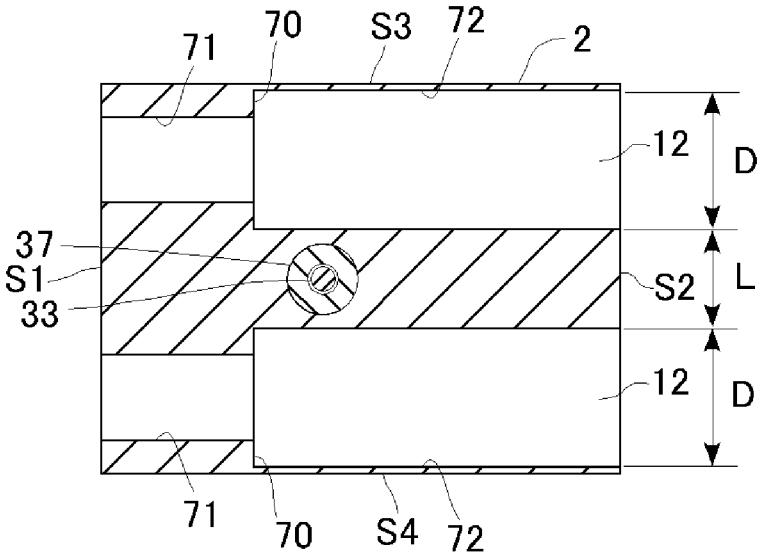

FIG. 1 is a front view of the expansion valve according to First embodiment. FIG. 2 is a sectional view of the expansion valve, taken along A-A Line in FIG. 1. FIGS. 3A and 3B are sectional views of the expansion valve, taken along B-B Line in FIG. 2. FIG. 3A illustrates a state in which a bolt is inserted, while FIG. 3B illustrates a state before the bolt is inserted. As illustrated in FIG. 1, an expansion valve 1 has a body 2 formed by performing predetermined cutting on a member that has been obtained by extrusion molding of a material made of an aluminum alloy. This body 2 has a prism shape, and a valve portion for throttling and expanding a refrigerant is provided in the inside thereof. A power element 3 functioning as a temperature sensing part is provided at the end portion in the longitudinal direction of the body 2.

An inlet port 6 (functions as a "first inlet port") is opened on the lower portion of the front surface of the body 2 (corresponds to a "second side surface"), while an outlet port 9 (functions as a "second outlet port") is opened on the upper portion thereof. A screw hole 10, in which a non-illustrated stud bolt for mounting a pipe can be implanted, is formed between the inlet port 6 and the outlet port 9. A pair of mounting holes 12 each penetrating the body 2 are formed side-by-side between the inlet port 6 and the outlet port 9. An outlet port 7 (functions as a "first outlet port") is opened on the lower portion of the non-illustrated back surface of the body 2 (corresponds to a "first side surface"), while an inlet port 8 (functions as a "second inlet port") is opened on the upper portion thereof (see FIG. 2).

That is, as illustrated in FIG. 2, the inlet port 6 for introducing the liquid refrigerant at high temperature and high pressure from the receiver side (condenser side); the outlet port 7 for delivering, toward the evaporator, the refrigerant at low temperature and low pressure, which has been throttled and expanded by the expansion valve 1; the inlet port 8 for introducing the refrigerant evaporated by the evaporator; and the outlet port 9 for delivering, to the compressor side, the refrigerant that has passed through the expansion valve 1 are provided in the side portion of the body 2.

In the expansion valve 1, a first refrigerant passage 13 is formed by the inlet port 6, the outlet port 7, and a refrigerant passage connecting these two ports together. A valve portion is provided in the intermediate portion of the first refrigerant passage 13, so that the refrigerant introduced from the inlet port 6 is changed to be in a mist state by being throttled and expanded with the valve portion and is delivered from the outlet port 7 toward the evaporator. On the other hand, a second refrigerant passage 14 is formed by the inlet port 8, the outlet port 9, and a refrigerant passage connecting these two ports together. The second refrigerant passage 14 extends straight such that the refrigerant is introduced from the inlet port 8 and delivered from the outlet port 9 toward the compressor. That is, a valve hole 16 is provided in the intermediate portion of the first refrigerant passage 13 in the body 2, and a valve seat 17 is formed by the open end edge on the inlet port 6 side of the valve hole 16. A valve element 18 is arranged so as to face the valve sheet 17 from the inlet port 6 side. The valve element 18 is formed by joining a spherical ball valve element for opening and closing the valve portion by attaching and detaching the valve sheet 17 to a valve element holder for supporting the ball valve element from the lower side.

At the lower end portion of the body 2, a communication hole 19 for communicating the inside and the outside of the body 2 is formed so as to intersect with the first refrigerant passage 13 at right angles, and a valve chamber 40 for housing the valve element 18 is formed by the upper half portion of the communication hole 19. The valve chamber 40 communicates, at its upper end portion, with the valve hole 16 and communicates, at its side portion, with the inlet port 6 via a small hole 42, thereby forming part of the first refrigerant passage 13. The small hole 42 is formed with the passage cross section of the first refrigerant passage 13 being locally made small, and is opened in the valve chamber 40.

An adjust screw 20 (corresponds to a "adjust member") is screwed in the lower half portion of the communication hole 19 so as to seal the communication hole 19 from the outside. A spring 23 biasing the valve element 18 to the valve closing direction is installed between the valve element 18 (correctly, the valve element holder) and the adjust screw 20. The load of the spring 23 can be adjusted by adjusting a screwing amount of the adjust screw 20 into the body 2. An O-ring 24 for preventing leakage of the refrigerant is installed between the adjust screw 20 and the body 2.

On the other hand, at the upper end portion of the body 2, a communication hole 25 for communicating the inside and the outside of the body 2 is formed so as to intersect with the second refrigerant passage 14 at right angles, and the power element 3 is screwed so as to seal the communication hole 25. The power element 3 has an upper housing 26 and a lower housing 27 and is structured such that a diaphragm 28 formed by a metal thin plate is positioned between the two housings 26 and 27 and a disk 29 is arranged on the lower housing 27 side. A gas for temperature sensing is enclosed in a closed space surrounded by the upper housing 26 and the diaphragm 28. An O-ring 30 for preventing leakage of the refrigerant is installed between the power element 3 and the body 2. The pressure and temperature of the refrigerant that passes through the second refrigerant passage 14 are transmitted to the lower surface of the diaphragm 28 via the communication hole 25 and a groove portion provided in the disk 29.

A partition wall by which the first refrigerant passage 13 and the second refrigerant passage 14 are partitioned from each other is provided at the center portion of the body 2, and a stepped hole 34 is provided in the partition wall. A lengthy shaft 33 (functions as an "actuating rod") is slidably inserted into a small-diameter portion 44 of the stepped hole 34. The shaft 33 is installed between the disk 29 and the valve element 18. Thereby, the drive force by a displacement of the diaphragm 28 is transmitted to the valve element 18 via the disk 29 and the shaft 33, thereby allowing the valve portion to be opened and closed. An O-ring 36, through which the shaft 33 is inserted, is arranged in the large-diameter portion of the stepped hole 34, thereby preventing leakage of the refrigerant between the first refrigerant passage 13 and the second refrigerant passage 14.

The upper half portion of the shaft 33 is inserted through a cylindrical holder 37 arranged so as to cross the second refrigerant passage 14. The lower end portion of the holder 37 is press-fitted into the large-diameter portion of the stepped hole 34, and hence a movement of the O-ring 36 is regulated by its lower end surface. The upper end portion of the shaft 33 is inserted through and in touch with a concave portion provided on the lower surface of the disk 29, while the lower end portion thereof is inserted through the valve hole 16 to be in contact with the valve element 18. A spring 39 for providing a predetermined lateral load to the shaft 33 is installed between the holder 37 and the shaft 33. With this lateral load, a vibration of the shaft 33, occurring due to a variation in the pressure of the refrigerant, can be suppressed.

As illustrated in FIGS. 3A and 3B, the pair of mounting holes 12 are formed on both sides of the body 2, the holder 37 being positioned between the both sides thereof. As illustrated in also FIGS. 1 and 2, each of the mounting holes 12 has its central axis at a height position between the first refrigerant passage 13 and the second refrigerant passage 14 in the body 2, and is provided so as to penetrate the body 2 from a first side surface S1 to a second side surface S2. A pair of bolts 62 (function as a "screw") are respectively inserted through the pair of mounting holes 12 from the side of the second side surface S2.

These bolts 62 are used for tightening a plate (not illustrated), which is a mounting member on the evaporator side, and the body 2 together. The mounting hole 12 is a stepped hole whose diameter is one-step reduced from the second side surface S2 toward the first side surface S1, and a stopper surface 70 is formed at the step portion that is the boundary between a small-diameter portion 71 and a large-diameter portion 72. The stopper surface 70 is formed by spot facing processing. When a bolt 62 is inserted through the mounting hole 62, the stopper surface 70 stops the head 66 of the bolt 62 in the insertion direction. The screw portion 64 of the bolt 62 penetrates the small-diameter portion 71 to be screwed in a screw hole in the plate.

In the present example, a hexagon socket head cap bolt is adopted as the bolt 62, and a hexagon socket 68 is formed on the end surface of the head 66. The bolt 62 can be easily tightened by using a hexagonal wrench. With such a structure, the heads 66 of the pair of bolts 62 can be arranged at positions respectively close to a third side surface S3 and a fourth side surface S4 of the body 2. In other words, it becomes possible to make the width between the third surface S3 and the fourth side surface S4 in the body 2 to be as small as possible, which is advantageous for blocking heat transfer and reducing weight. Alternatively, other screws, such as, for example, a slotted bolt, can be adopted as the bolt 62.

Herein, the stopper surface 70 is formed so as to be located near to the first side surface S1 relative to the central axis of the shaft 33, and is positioned such that the head 66 of the bolt 62 overlaps the position of the central axis of the shaft 33 in the insertion direction. As a result, when the bolt 62 has been tightened, a large space can be formed near to the second side surface S2 relative to the head 66 in the large-diameter portion 72. Further, because a space is formed between the outer surface of the head 66 of the bolt 62 and the inner surface of the large-diameter portion 72, an insulation effect can be obtained. With the space in this portion, the heat insulation from a portion, with which the low-temperature refrigerant immediately after passing through the valve portion is in contact, can be efficiently achieved. Further, because it is formed such that the inner diameter D of the large-diameter portion 72 is larger than the distance L between the pair of the mounting holes 12, a large space portion can be formed in the illustrated cross section. With the space, the heat transfer from the first refrigerant passage 13 side to the second refrigerant passage 14 side can be suppressed, and a temperature sensing error in the power element 3 can be prevented.

On the other hand, because the position of the head 66 of the bolt 62 is limited to a degree in which the position thereof overlaps that of the central axis of the shaft 33, the bolt 62 in the body 2 can be tightened at a position near to the shaft 33, i.e., near to the center of gravity of the body 2, thereby allowing a state of stably supporting the expansion valve 1, when fixed near to the evaporator, to be maintained. Further, by making the space formed by the mounting hole 12 to be large with the position of the head 66 of the bolt 62 being set in the back of the mounting hole 12, a reduction in the weight of the body 2 can be achieved and a short bolt 62 can be used. Thereby, reductions in the weight and cost of the whole air-conditioner including the expansion valve 1 can be achieved. Although the scraps of an aluminum alloy are increased when the depth of the spot facing processing is made large in forming the mounting hole 12, cost can also be reduced by reusing the aluminum alloy. Further, it is not needed to use, as the bolt 62, a relatively long bolt that has been used before, and hence there is the merit that short bolts used for tightening the pipes in other portions in the refrigeration cycle, such as the external heat exchanger, can be used in common.

The expansion valve 1 formed as stated above is produced as follows. That is, a billet made of an aluminum alloy is first extruded in one direction (i.e., direction in which the front surface and the back surface of the body 2 are connected together) by extrusion using a predetermined molding die, and a member, which will be a material of the body 2, is then molded to have a shape of the outline of the front surface thereof. Thereafter, a half-finished product of the body 2 is formed by cutting off the member in the direction perpendicular to the extrusion direction. The body 2 can be obtained by performing, on this half-finished product, predetermined cutting, such as drilling.

Each of the first refrigerant passage and the second refrigerant passage is formed by drilling, with a drill, a hole on each of the first side surface S1 and the second side surface S2 of the half-finished product. The pair of the mounting holes 12 are formed by forming, with a drill, a through-hole from the second side surface S2 toward the first side surface S1 and then by performing spot facing processing with an end mill, etc.

The expansion valve 1 is connected, on the first side surface S1 of the body 2, to the pipe extending from the evaporator via a non-illustrated plate. In the plate, supporting holes are provided at positions that respectively face the outlet port 7 and the inlet port 8 when the plate is assembled to the body 2, and screw holes are provided at positions that respectively face the mounting holes 12. Connecting parts, for both the pipe leading to the inlet port of the evaporator and the pipe leading to the outlet port thereof, are respectively inserted through the supporting holes and supported so as not to drop. The plate and the body 2 are arranged face-to-face by inserting the tip portions s of the respective pipes into the outlet port 7 and the inlet port 8 via sealing members, such as O-rings. The plate and the body 2 are then tightened together by respectively inserting, from the side of the second side surface S2 of the body 2, the bolts 62 through the pair of the mounting holes 12 to be screwed in the screw holes in the plate.

The expansion valve 1 is also connected to both the pipe leading to the receiver and the pipe leading to the compressor via a non-illustrated plate. In the plate, supporting holes are provided at positions that respectively face the inlet port 6 and the outlet port 9 when the plate is assembled to the body 2, and an insertion hole is provided at a position that faces the screw hole 10. Connecting parts, for both the pipe leading to the outlet port of the receiver and the pipe leading to the inlet port of the compressor, are respectively inserted through the supporting holes and supported so as not to drop. The plate and the body 2 are arranged face-to-face by inserting the tip portions of the respective pipes into the inlet port 6 and the outlet port 9 via sealing members, such as O-rings. The plate and the body 2 are then tightened together by inserting a predetermined bolt through the insertion hole in the plate to be screwed in the screw hole 10.

In the expansion valve 1 formed as stated above, the diaphragm 28 is displaced with the power element 3 sensing the pressure and temperature of the refrigerant that has returned from the evaporator via the inlet port 8. The displacement of the diaphragm 28 serves as driving force that is transmitted to the valve element 18 via the disk 29 and the shaft 33 to open and close the valve portion. On the other hand, the liquid refrigerant supplied from the receiver is introduced from the inlet port 6 and is changed to a misty refrigerant at low temperature and low pressure by being throttled and expanded when passing through the valve portion. The refrigerant is delivered from the outlet port 7 toward the evaporator.

[Variation]

Figure 4A:
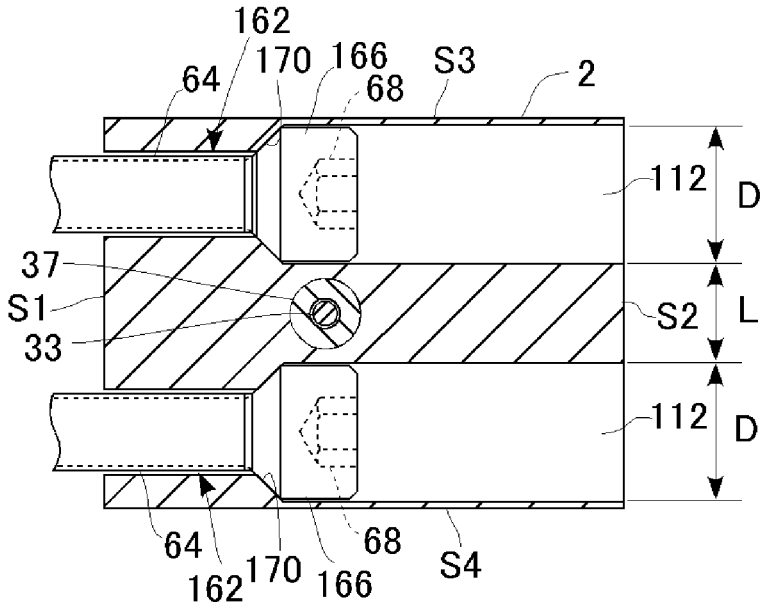
FIGS. 4A and 4B are cross-sectional views respectively illustrating the structure of a mounting hole and the mounting structure of a bolt according to a variation of First Embodiment.
Figure 4B:
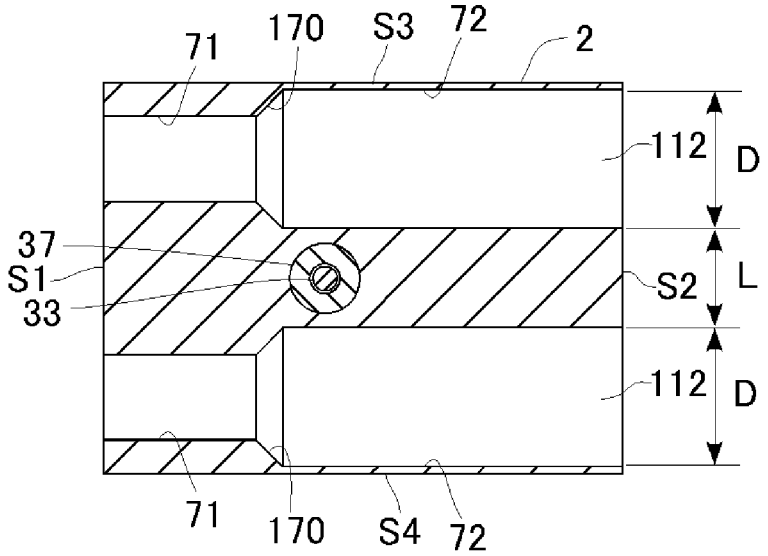

FIGS. 4A and 4B are cross-sectional views respectively illustrating the structure of a mounting hole and the mounting structure of a bolt according to a variation of First Embodiment. These views correspond to FIGS. 3A and 3B, respectively. In the present variation, a stopper surface 170 in a mounting hole 112 is formed as a tapered surface that is inclined radially inward toward the direction in which a bolt 162 is inserted. The apical surface of the head 166 of the bolt 162 to be inserted also has a tapered shape. With such a structure, a transmission efficiency of the tightening torque, occurring when the bolt 162 is tightened, can be enhanced and a stable tightening can be achieved. Accordingly, the body 2 can be is stably fixed even when the bolt 162 is made short as illustrated.

Second Embodiment

Figure 5:
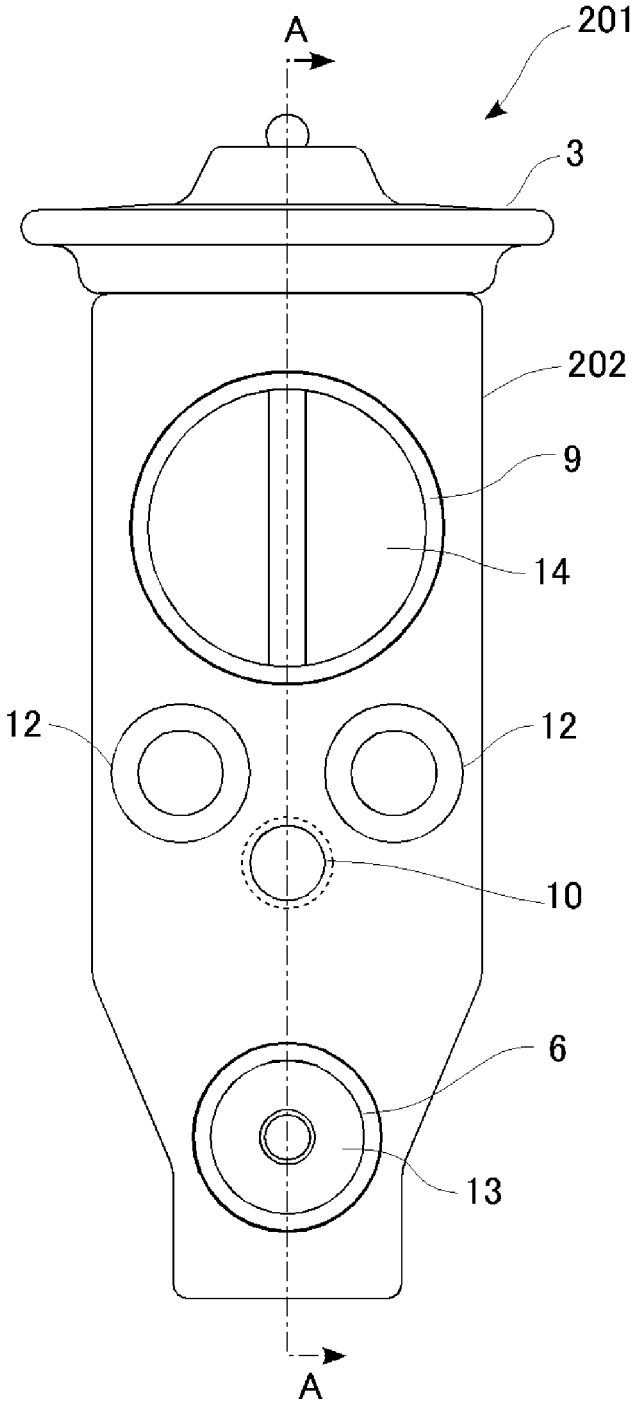
FIG. 5 is a front view of an expansion valve according to Second embodiment.
Figure 6:
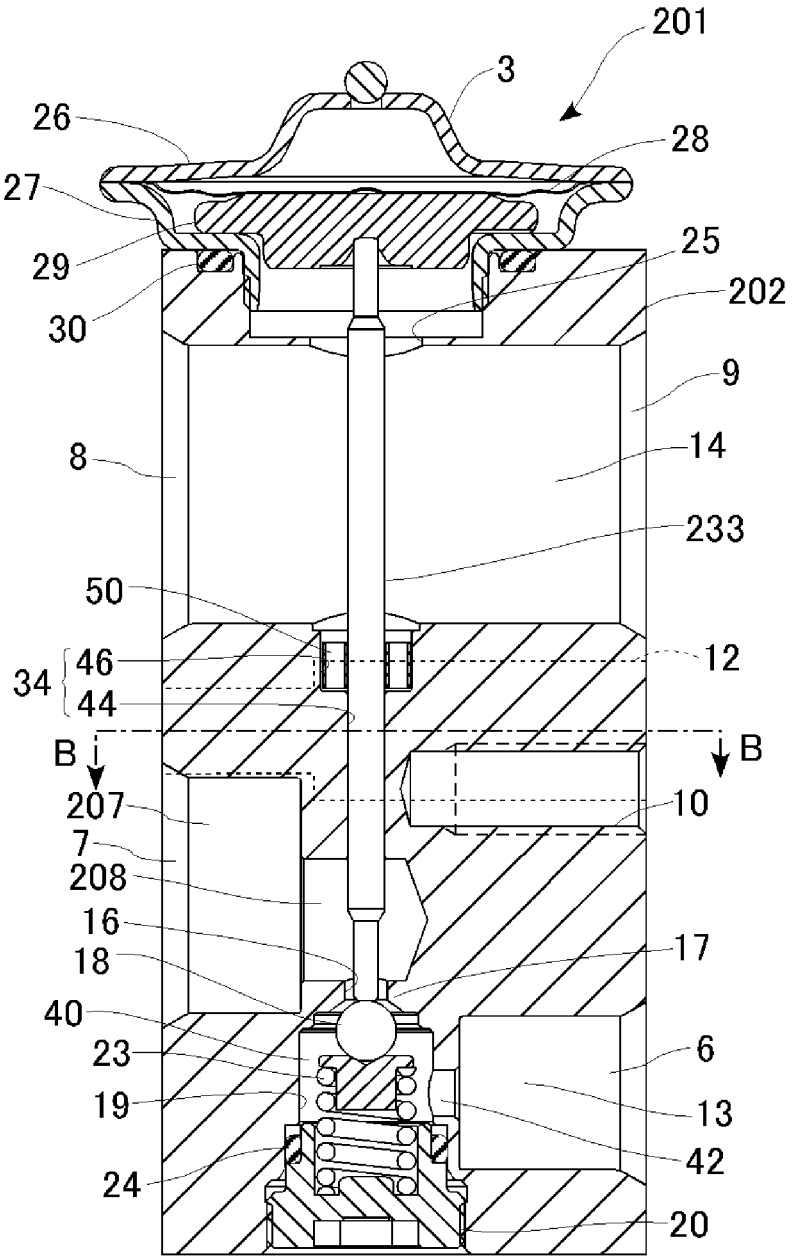
FIG. 6 is a sectional view of the expansion valve, taken along A-A Line in FIG. 5.
Figure 7A:
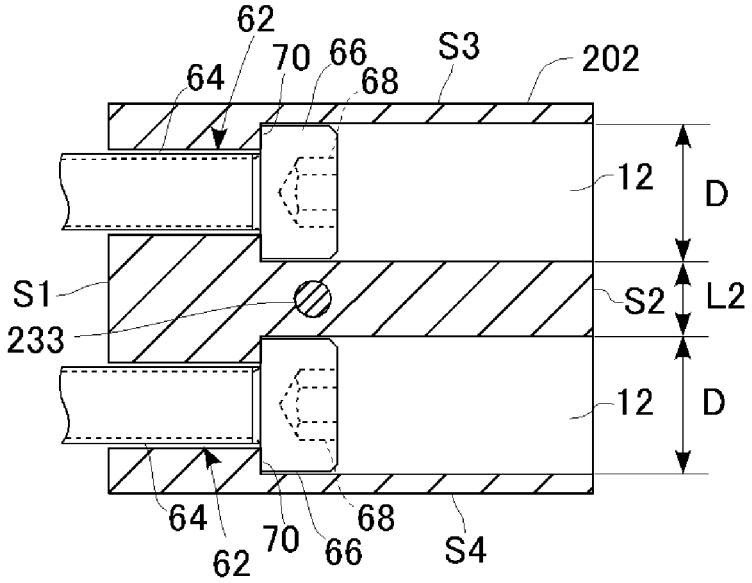
FIGS. 7A and 7B are sectional views of the expansion valve, taken along B-B Line in FIG. 6.
Figure 7B:
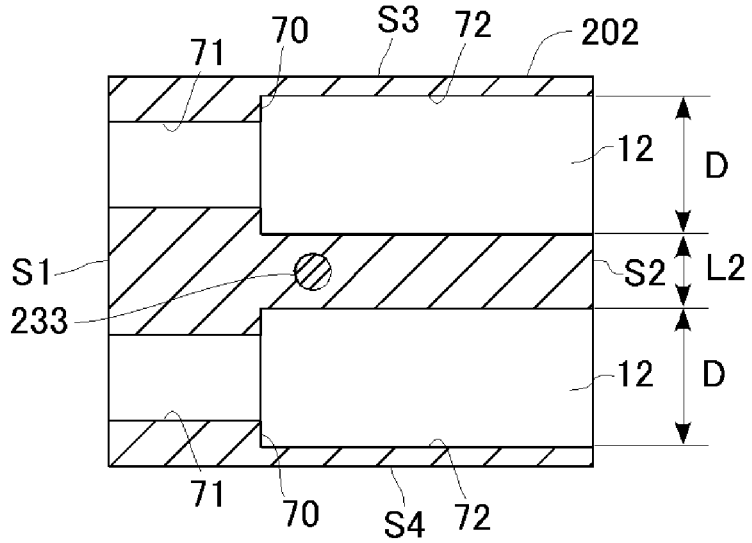

An expansion valve according to the present embodiment has the same structure as in First Embodiment, except that a height position of the mounting hole in the body and a structure in which the shaft is supported are different. Accordingly, description will be made centering on the points different from First Embodiment. FIG. 5 is a front view of an expansion valve according to Second Embodiment. FIG. 6 is a sectional view, taken along A-A Line in FIG. 5. FIGS. 7A and 7B are sectional views, taken along B-B Line in FIG. 6. FIG. 7A illustrates a state in which a bolt is inserted, while FIG. 7B illustrates a state before the bolt is inserted.

As illustrated in FIG. 5, in an expansion valve 201, the height position of each of the pair of the mounting holes 12 in a body 202 is lower than that in First Embodiment. As illustrated in FIG. 6, in the present embodiment, the intermediate portion of a shaft 233 is made slightly fatter than the shaft 33 in First Embodiment to enhance the stiffness. On the other hand, a holder for inserting the shaft 233 is not provided. The upper half portion of the shaft 233 crosses the second refrigerant passage 14 and the lower half portion thereof slidably penetrates the small-diameter portion 44 of the stepped hole 34. In the large-diameter portion 46 of the stepped hole 34, that is, between the end portion on the second refrigerant passage 14 side of the partition wall and the shaft 233 in the body 202, a spring vibration isolator 50 for providing, to the shaft 233, biasing force in the direction perpendicular to the axial direction, i.e., providing a lateral load (sliding load), is arranged. It is structured that a vibration of the shaft 233 or the valve element 18, occurring due to a variation in the pressure of the refrigerant, can be suppressed with the shaft 233 receiving the lateral load from the spring vibration isolator 50.

Although the passage of the first refrigerant passage 13 on the downstream side from the valve hole 16 has a stepped structure formed by both a large-diameter portion 207 including the outlet port 7 and a small-diameter portion 208 located in the back thereof, the central axis of the small-diameter portion 208 is more biased to the valve hole 16 side than the central axis of the large-diameter portion 207. It is structured that, with such a structure, the passage on the downstream side and the mounting hole 12 do not interfere with each other.

As illustrated in FIGS. 7A and 7B, because the holder 37 used in First Embodiment is not provided in the present embodiment, a pair of the mounting holes 12 are formed in the body 202 so as to approach the shaft 233. As a result, the distance L2 between the pair of the mounting holes 12 becomes smaller than the distance L in First Embodiment, although the inner diameter D of the large-diameter portion 72 is the same as that in First Embodiment. The width between the third side surface S3 and the fourth side surface S4 can be made smaller by that much, and the ratio of a space on the same cross-sectional plane becomes larger than that in First Embodiment. As a result, the heat transfer from the first refrigerant passage 13 side to the second refrigerant passage 14 side can be further suppressed than in First Embodiment.

Figure 8A:
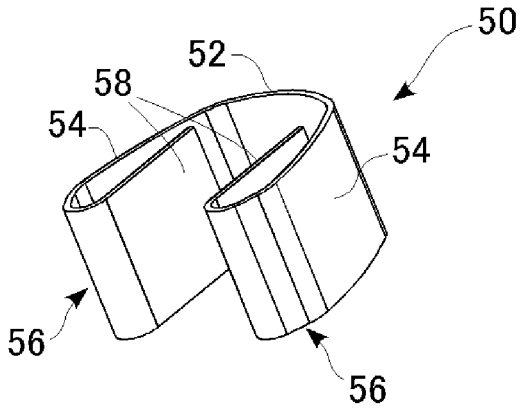
FIGS. 8A to 8C are views illustrating the structure of a spring vibration isolator.
Figure 8B:
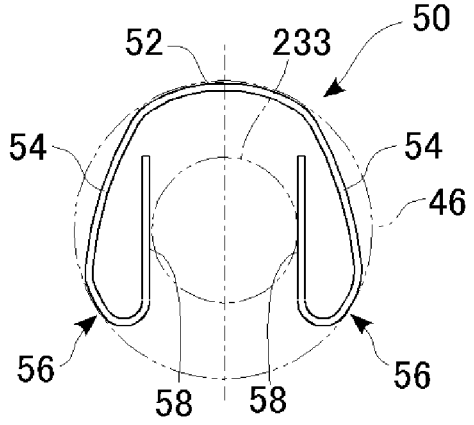
Figure 8C:
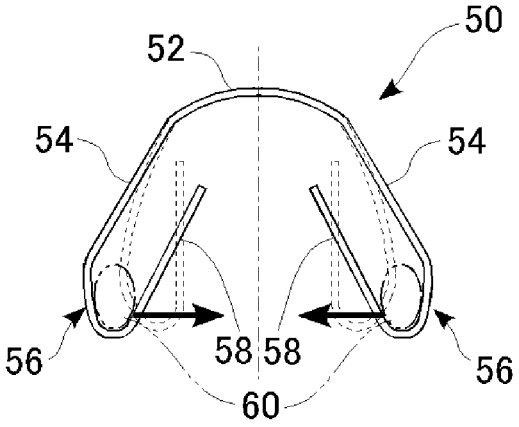

FIGS. 8A to 8C are views illustrating the structure of a spring vibration isolator, in which: FIG. 8A is a perspective view illustrating the whole structure of the spring vibration isolator; FIG. 8B is a plan view illustrating a state in which the spring vibration isolator is inserted into a stepped hole; and FIG. 8C is a plan view illustrating a state in which no load is applied to the spring vibration isolator.

As illustrated in FIGS. 8A and 8B, a spring vibration isolator 50 is formed by bending a strip-shaped plate material that is formed by a metal having a high elastic modulus, for example, a stainless steel, at multiple positions along the extending direction. Specifically, it is formed by forming, with so-called forming processing, a plate material having a lengthy rectangular shape into a generally circular shape in which the middle of the plate material has arc-shaped roundness, and during the above processing by folding inward both end portions of the plate material so as to be symmetric with respect to the bisector of the intermediate portion 52 (see the dashed-dotted line).

That is, as illustrated in FIGS. 8B and 8C, the spring vibration isolator 50 has: the intermediate portion 52 having a curvature almost the same as that of the large-diameter portion 46 of the stepped hole 34; external spring portions 54 that linearly extend on both sides of the intermediate portion 52; and folded-back portions 56 formed with the tips of the external spring portions 54 being respectively folded inward. Linear internal spring portions 58 are continuously connected to the folded-back portions 56, respectively. In a state where no load is applied to the spring vibration isolator 50, occurring before the isolator 50 is inserted into the large-diameter portion 46, the external spring portions 54 extend almost linearly, as illustrated in FIG. 8C.

When the spring vibration isolator 50 is to be inserted into the large-diameter portion 46, the spring vibration isolator 50 is first made to be almost circularly shaped by the following way, as illustrated by the dotted lines in FIG. 8C, and then inserted thereinto. The tips of a tool 60, such as, for example, a pair of tweezers, are inserted into a pair of the folded-back portions 56, and then a load is applied so as to approach both the folded-back portions 56 each other (see the arrows in FIG. 8C). That is, the pair of the folded-back portions 56 respectively function as grips, when the spring vibration isolator 50 is to be inserted into the large-diameter portion 46. At the time, the tips of the tool 60 are arranged inside the circumcircle of the spring vibration isolator 50, that is, it is not needed to grasp the spring vibration isolator 50 from the outside thereof, and hence there is caused no case where the tool is caught at the edge of the large-diameter portion 46 when inserted, thereby allowing the work to be easily performed. At the time, the pair of the internal spring portions 58 become almost parallel to each other.

Because the spring vibration isolator 50 is inserted into the large-diameter portion 46 in a state where the insulator 50 has been elastically deformed from a non-load state, the pair of the internal spring portions 58 generate a lateral load in the direction in which the shaft 233 is positioned between the internal spring portions, as illustrated in FIG. 8B. On the other hand, the external spring portions 54 are in a slightly bowed state, and hence a load by which part of the folded-back portion 56 is pressed onto the inner surface of the large-diameter portion 46 is generated. The spring vibration isolator 50 provides a sliding load by contacting the shaft 233 at two points in this way, and on the other hand, is firmly fixed to the large-diameter portion 46 (i.e., body 2) by its elastic reaction force.

With such a structure, an adequate sliding resistance can be provided to the shaft 233 by the spring vibration isolator 50, and as a result, a vibration of the shaft 233 or the valve element 18, occurring due to a variation in the pressure of the refrigerant, can be suppressed. Also, because the spring vibration isolator 50 can be particularly obtained by an easy process in which a single strip-shaped plate material is bent along the extending direction, a waste of material is hardly generated even when the plate material is obtained by being cut out of a large plate material, thereby allowing production cost to be suppressed.

Also, because the external spring portion 54 and the internal spring portion 58 are formed by the whole width of the plate of the spring vibration isolator 50, they can be formed to be compact in the width direction. Further, because the pair of the folded-back portions 56 are provided such that the tips of the tool 60 can be arranged inside the spring vibration isolator 50, the work for attaching the spring vibration isolator 50 to the body 202 can be done very easily. In particular, when the expansion valve 201 is to be reduced in size, both the large-diameter portion 46 and the spring vibration isolator 50 become small; however, the spring vibration isolator 50 can be easily grasped and the work can be done in a reduced space, and hence work efficiency is remarkably improved.

Third Embodiment

Figure 9:
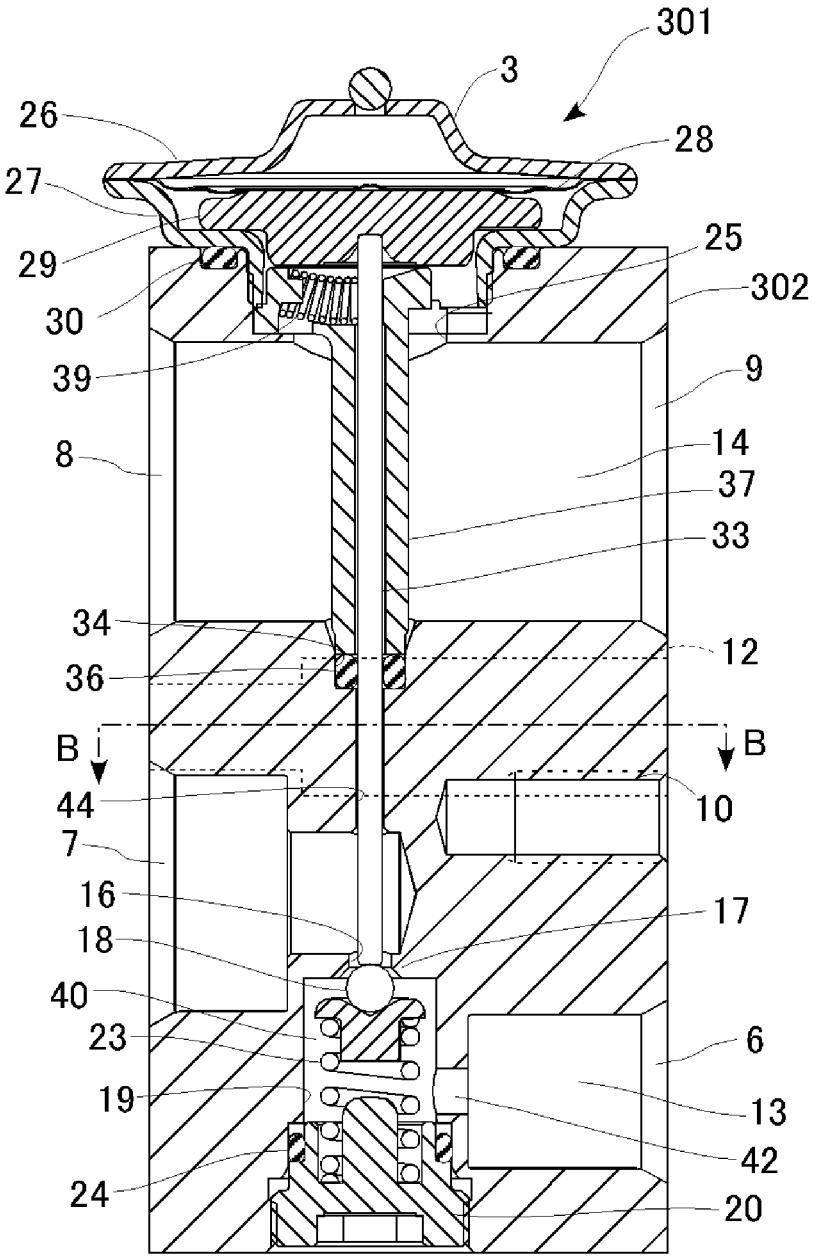
FIG. 9 is a sectional view of an expansion valve according to Third Embodiment.
Figure 10A:
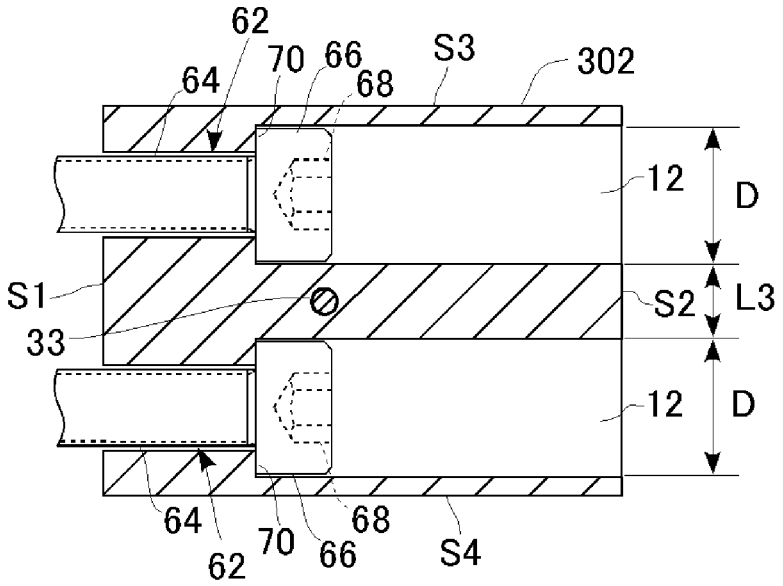
FIGS. 10A and 10B are sectional views of the expansion valve, taken along B-B Line in FIG. 9.
Figure 10B:
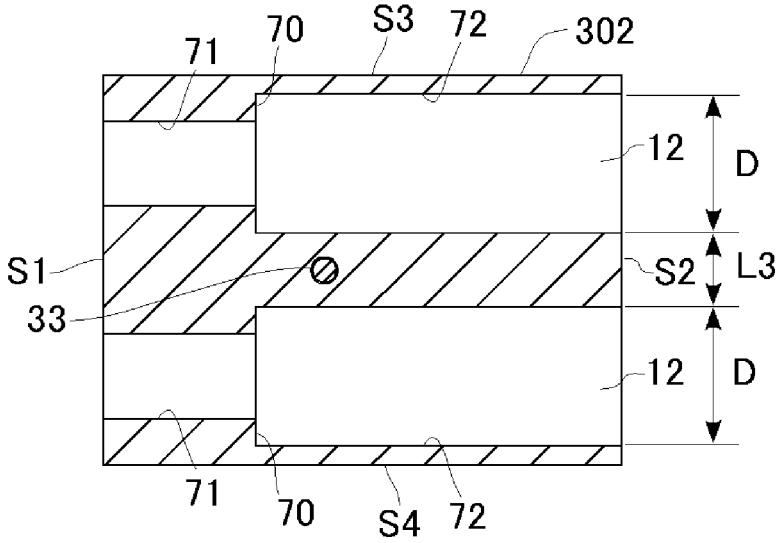

An expansion valve according to the present embodiment has the same structure as in First Embodiment, except that a height position of the mounting hole in the body and a position of the sealing member are different. Accordingly, description will be made centering on the points different from First Embodiment. FIG. 9 is a sectional view of an expansion valve according to Third Embodiment. FIGS. 10A and 10B are sectional views of the expansion valve, taken along B-B Line in FIG. 9. FIG. 10A illustrates a state in which a bolt is inserted, while FIG. 10B illustrates a state before the bolt is inserted.

As illustrated in FIG. 9, in an expansion valve 301, the height position of each of the pair of the mounting holes 12 in a body 302 is low, similarly in Second Embodiment. The large-diameter portion of the stepped hole 34 is formed to be relatively shallow, and the O-ring 36 is arranged near to the second refrigerant passage 14 relative to the central axis of the mounting hole 12 so as not to interfere with the mounting hole 12. That is, the O-ring 36 is arranged between the end portion on the second refrigerant passage 14 side of the partition wall in the body 302 and the shaft 33. With such a structure, the holder 37, the O-ring 36, and the mounting hole 12 do not interfere with each other.

As a result, the pair of the mounting holes 12 are formed in the body 302 so as to approach the shaft 33, as illustrated in FIG. 10. As a result, the distance L3 between the pair of the mounting holes 12 becomes smaller than the distance L in First Embodiment, although the inner diameter D of the large-diameter portion 72 is the same as that in First Embodiment. That is, similarly in Second Embodiment, the width between the third side surface S3 and the fourth side surface S4 can be made small, and the ratio of a space on the same cross-sectional plane becomes larger than that in First Embodiment. As a result, the heat transfer from the first refrigerant passage 13 side to the second refrigerant passage 14 side can be further suppressed than in First Embodiment.

Preferred embodiments of the present invention have been described above, but it is needless to say that the invention should not be limited to the specific embodiments and various variations may be made within the scope of the technical idea of the invention. For example, in the aforementioned embodiments and variations, part of the components may be combined or part of the components may be omitted from each of the embodiments and variations.

The expansion valve according to each of the aforementioned embodiments can be preferably used in a refrigeration cycle using, as a refrigerant, Hydrochlorofluorocarbon (HFC-134a), etc., but the expansion valve according to the present invention can also be used in a refrigeration cycle using a refrigerant having high working pressure, such as carbon dioxide. In that case, an external heat exchanger, such as a gas cooler, is arranged in the refrigeration cycle, instead of a condenser. In that case, in order to compensate the strength of the diaphragm that forms the power element 3, for example, a disk spring made of a metal may be arranged in a state of being overlapped on the diaphragm. Alternatively, a disk spring may be arranged instead of the diaphragm.

While the preferred embodiments of the present invention have been described using specific terms, such description is for illustrative purposes only, and it is to be understood that changes and variations may be made without departing from the spirit or scope of the appended claims.

What is claimed is:

1. An expansion valve that is provided in a refrigeration cycle; that throttles and expands a refrigerant inflowing via an external heat exchanger by making the refrigerant pass through a valve portion in an inside thereof to supply to an evaporator; and that controls an opening degree of the valve portion by sensing a pressure and a temperature of the refrigerant that has returned from the evaporator and delivers the refrigerant toward a compressor, the expansion valve comprising:

a first refrigerant passage that is formed so as to penetrate a body thereof, where at one end side of the first refrigerant passage a first inlet port is provided for introducing the refrigerant from the external heat exchanger, while at an other end side of the first refrigerant passage a first outlet port is provided for delivering the refrigerant to the evaporator;

a valve hole provided in an intermediate portion of the first refrigerant passage; a valve chamber provided between the valve hole and the first inlet port in the first refrigerant passage;

a valve element that is arranged in the valve chamber for opening and closing the valve portion by touching and leaving the valve hole;

a second refrigerant passage that is formed separately from the first refrigerant passage so as to penetrate the body thereof, where at one end side of the second refrigerant passage a second inlet port is provided for introducing the refrigerant that has returned from the evaporator, while at an other end side of the second refrigerant passage a second outlet port is provided for delivering the refrigerant to the compressor;

a power element that is provided on a side opposite to the first refrigerant passage with respect to the second refrigerant passage in the body, and that works by sensing the temperature and pressure of the refrigerant flowing through the second refrigerant passage;

an actuating rod whose one end side crosses the second refrigerant passage to be connected to the power element and where an other end side of the actuating rod penetrates both a partition wall between the first refrigerant passage and the second refrigerant passage and the valve hole to be connected to the valve element, and that transmits a drive force of the power element to the valve element;

a mounting hole that has its central axis at a height position between the first refrigerant passage and the second refrigerant passage in the body, and that is provided so as to penetrate both a first side surface, on which the first outlet port and the second inlet port are opened, and a second side surface located on a back surface side of the first side surface, and that is used for inserting, from the side of the second side surface, a screw for tightening a mounting member on the evaporator side and the body together; and a screw hole that is formed in the second side surface and in which a stud bolt can be implanted, the stud bolt being for fastening a plate, which is provided on a compressor and external heat exchanger side of the body, and the body onto each other, wherein the mounting hole has, in an inside thereof, a stopper surface for stopping a head of the screw in an insertion direction, the stopper surface is located near to the first side surface that is on one side of a central axis of the actuating rod, and when the screw is inserted in the mounting hole, the head of the screw when stopped at the stopper surface is located at about the central axis of the actuating rod leaving a space between the head of the screw and the second side surface in which part of the screw is not present;

in the mounting hole, the stopper surface is positioned such that the head of the screw overlaps the position of the central axis of the actuating rod in the insertion direction;

the mounting hole is one of a pair of the mounting holes, each of the mounting holes being disposed in the body on a respective side of the actuating rod, such that the actuating rod is positioned between the mounting holes; and an inner diameter of each of the pair of the mounting holes, near to the second side surface relative to the stopper surface, is larger than a distance between the pair of the mounting holes.

2. The expansion valve according to claim 1, wherein the stopper surface in the mounting hole is formed as a tapered surface that is inclined radially inward toward the direction in which the screw is inserted.

3. The expansion valve according to claim 1 comprising:

a spring vibration isolator that is installed, near to the second refrigerant passage relative to the central axis of the mounting hole in the body, between an end portion on the second refrigerant passage side of the partition wall and the actuating rod, and that provides sliding resistance by biasing the actuating rod.

4. The expansion valve according to claim 3, wherein the spring vibration isolator is formed by bending an elastic strip-shaped plate material at multiple positions along an extending direction.

5. The expansion valve according to claim 1 comprising:

a flexible sealing member that is installed, near to the second refrigerant passage relative to the central axis of the mounting hole in the body, between an end portion on the second refrigerant passage side of the partition wall and the actuating rod.

* * * * *